US007052390B2

(12) United States Patent
Otto et al.

(10) Patent No.: US 7,052,390 B2
(45) Date of Patent: May 30, 2006

(54) REVOLVING DOOR

(75) Inventors: Gertjan Otto, Purmerend (NL); Ronald Frank Joosten, Ijmuiden (NL); Volkert Fester, Siegburg (DE)

(73) Assignee: Boon Edam B.V., Edam (NL)

( * ) Notice: Subject to any disclaimer, the term of this patent is extended or adjusted under 35 U.S.C. 154(b) by 83 days.

(21) Appl. No.: 10/782,022

(22) Filed: Feb. 18, 2004

(65) Prior Publication Data

US 2004/0172880 A1 Sep. 9, 2004

Related U.S. Application Data

(63) Continuation of application No. PCT/NL03/00456, filed on Jun. 20, 2003.

(30) Foreign Application Priority Data

Jun. 20, 2002 (NL) ..... 1020907

(51) Int. Cl.
*F24F 3/18* (2006.01)

(52) U.S. Cl. ..... 454/195; 454/185

(58) Field of Classification Search ..... 49/39, 49/40, 41, 42; 454/188, 189, 191
See application file for complete search history.

(56) References Cited

U.S. PATENT DOCUMENTS

| | | | | |
|---|---|---|---|---|
| 5,042,367 | A * | 8/1991 | Hopkins | 454/195 |
| 5,878,529 | A * | 3/1999 | Huber | 49/68 |
| 6,375,562 | B1 * | 4/2002 | Hein | 454/188 |
| 6,857,956 | B1 * | 2/2005 | Fuchs | 454/195 |

FOREIGN PATENT DOCUMENTS

| | | | |
|---|---|---|---|
| DE | 4126924 | C1 | 11/1992 |
| DE | 19911220 | C1 | 6/2000 |
| DE | 20006968 | U1 | 5/2001 |
| DE | 10018868 | A1 * | 10/2001 |

* cited by examiner

*Primary Examiner*—Derek S. Boles
(74) *Attorney, Agent, or Firm*—Jeffrey D. Myers; Vidal A. Oaxaca; Peacock Myers, P.C.

(57) ABSTRACT

A revolving door for installation in a building, comprising a cylindrical shell wall, within the shell wall door leaves rotating about a central shaft and between a bottom plate and a top plate, and entrance and exit openings provided in the shell wall, at least one of which having an air-outflow unit disposed at a vertical edge of the shell wall, having an outlet slot for the generation of a vertically oriented and between the bottom plate and the top plate oriented air curtain substantially filling the headroom of the door, wherein the outlet slot is directed substantially radially towards the interior of the revolving door, and wherein during use the door leaves provide an antidraught seal, with the air-outflow unit being placed inside the building.

3 Claims, 2 Drawing Sheets

REVOLVING DOOR

Figure 1:
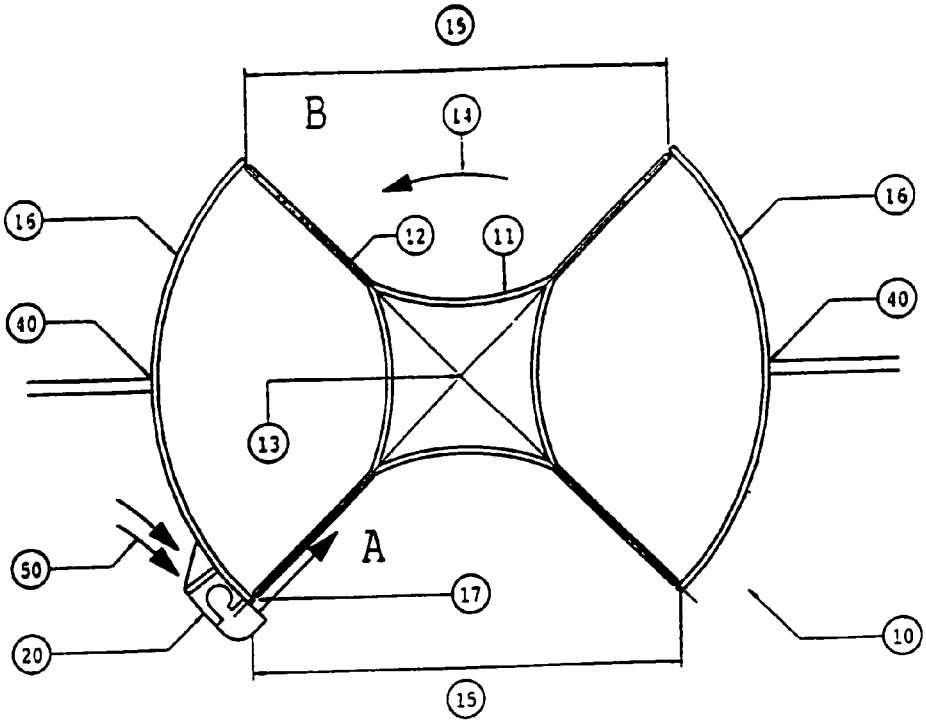

This application is a continuation-in-part of PCT/NL03/00456 filed Jun. 20, 2003

The invention relates to a revolving door for installation in a building, comprising a cylindrical shell wall, within the shell wall door leaves rotating about a central shaft, and entrance and exit openings provided in the shell wall, at least one of which having an air-outflow unit disposed at a vertical edge of the shell wall, having an outlet slot for the generation of a vertically oriented air curtain.

Such a revolving door is known from the German utilisation model DE-U-200 06 968. The door leaves of this rotating door are usually rotatably disposed between a bottom plate and an top plate. The air curtain extends between said bottom plate and top plate, such that the headroom of the door is substantially filled with the air curtain.

Practice shows that the known revolving door does not provide an effective separation between the indoor climate and outdoor climate of a building in which the revolving door is employed.

It is the object of the invention to improve the known revolving door in this respect and generally to provide an alternative for the known revolving door.

To this end the revolving door according to the invention is characterised in that the outlet slot is directed substantially radially towards the interior of the revolving door, and in that during use the door leaves provide an antidraught seal, with the air-outflow unit being placed inside the building.

Surprisingly, the revolving door according to the invention is shown to be satisfactory in practice. Applicants believe the reason for this to be that the measures according to the invention cause a locally increased ambient pressure in the revolving door's atmosphere, which is maintained during use of the revolving door because the section between the door leaves, within which by means of the air-outflow unit an elevated ambient pressure is created, is due to further rotation initially sealed by the door leaves and shell wall, and subsequently exits at the opening opposite the air-outflow unit. The elevated pressure allows efflux to take place at this opening, but no influx of ambient air from outside the revolving door. The result is that the external environment is adequately closed off from the environment inside the revolving door. Further rotation of the revolving door subsequently again causes a closing off by the door leaves and the shell wall, so that when the section of the revolving door reaches the air-outflow unit, the pressure in this section of the revolving door can be elevated again. For the revolving door according to the invention to function properly it is essential, as will be clear from the foregoing, that during use the door leaves provide the revolving door with an antidraught closure.

It is observed that DE-C-41 26 924 discloses the use with a revolving door of a radially inwardly directed air-flow. However, the air-outflow unit mentioned in this publication is not located inside the building but outside the building, and moreover, reaches only from the bottom plate to approximately the middle of the door, so as to displace cold air by means of efflux to the atmosphere outside.

To further boost the separation between indoor climate and outdoor climate, it is desirable for a second air-outflow unit to be provided outside the building, of which an outlet slot is directed substantially radially towards the interior of the revolving door.

It is also desirable for the air-outflow unit or air-outflow units to have a suction opening for air that is in communication with the atmosphere inside the building.

Figure 2:
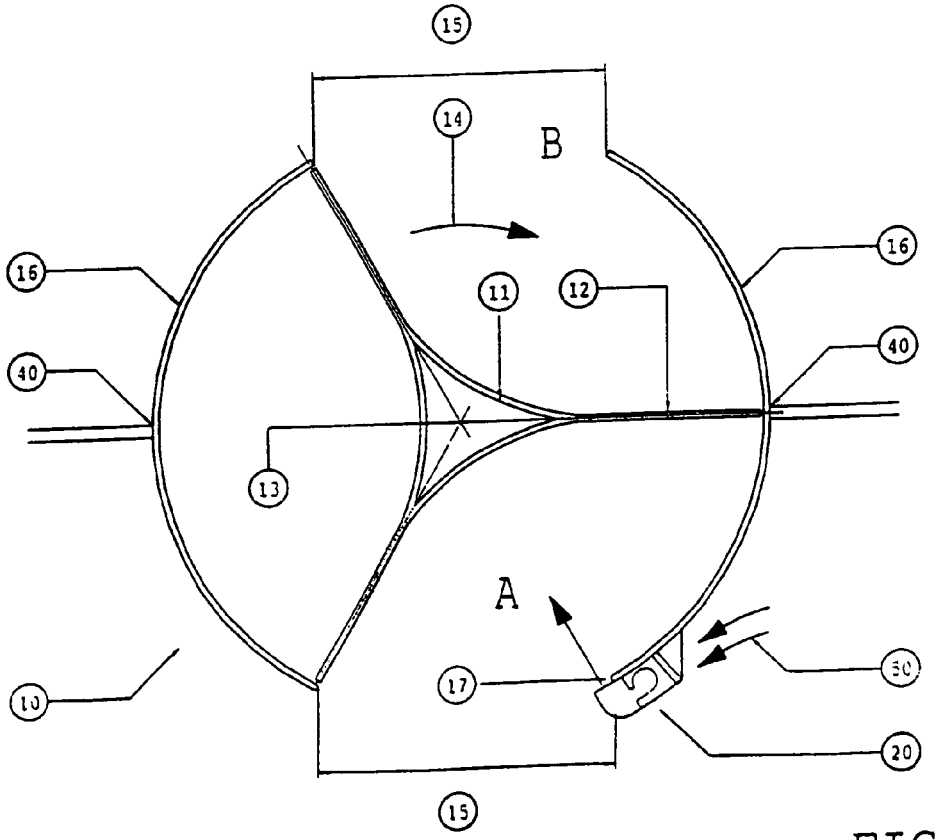
Figure 3:
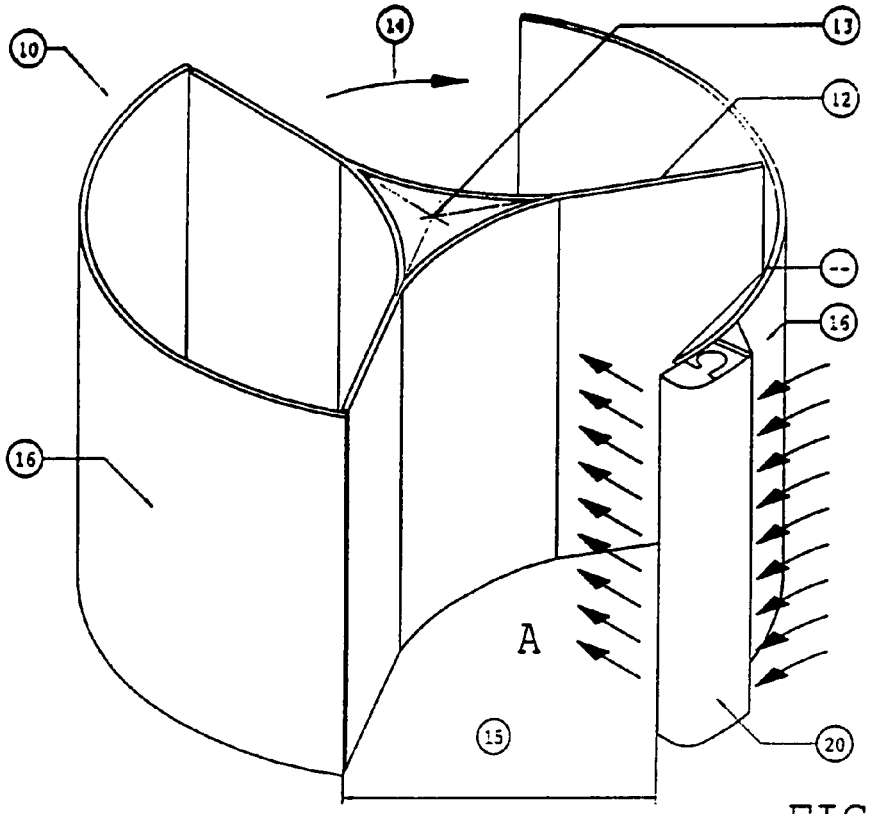
Figure 4:
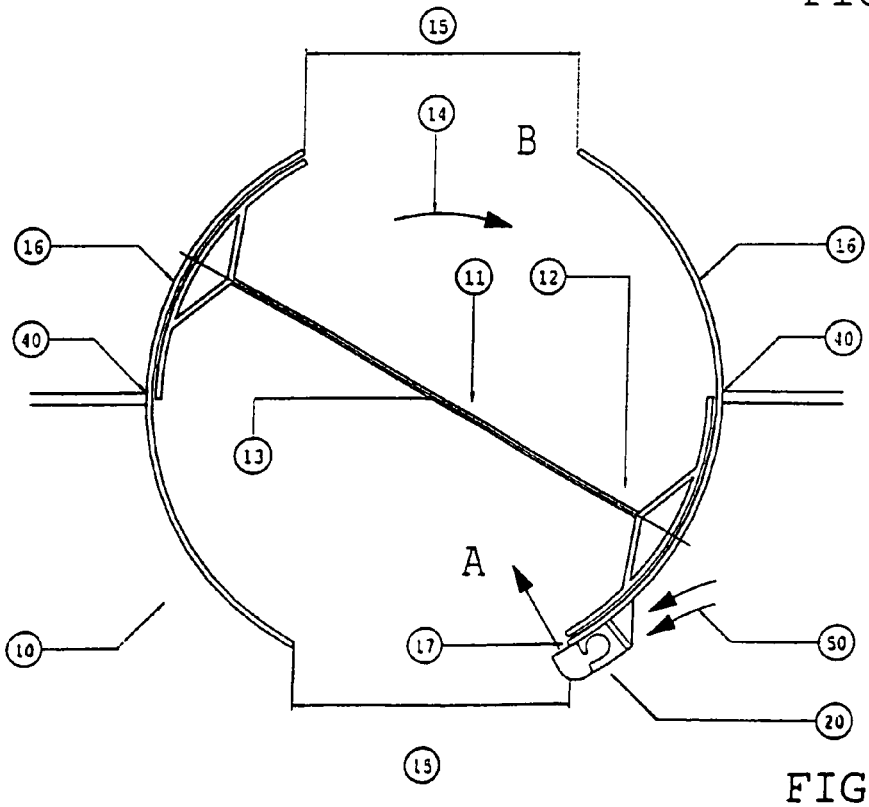

Below the invention will be further elucidated with reference to the drawing, which in FIG. 1 shows a schematic cross-sectional illustration of a first exemplary embodiment of a four-leafed revolving door according to the invention;

in FIG. 2 shows a schematic cross-sectional illustration of a second exemplary embodiment of a revolving door according to the invention having three door leaves;

in FIG. 3 shows an oblique top view of the revolving door shown in FIG. 2, and in FIG. 4 shows a schematic cross-sectional view of a third exemplary embodiment of a revolving door according to the invention having two door leaves.

Similar parts in the figures carry the same reference numbers.

FIG. 1 shows a revolving door 10 according to the invention, installed in an opening 40 of a facade of a building. In this exemplary embodiment the revolving door 10 has shell walls 16, which are curved circularly and within which there is a centrally placed turning construction 11, which in the present exemplary embodiment is provided with four door leaves 12 attached thereto.

The shell walls 16 may be made, for example, of glass and may further be provided with protective profiles at the top and bottom. In order to operate the turning construction 11 with the door leaves 12 attached thereto a drive train, which is known in itself, may be provided to engage the turning construction 11 above or below (not shown).

The turning construction 11 with the door leaves 12 attached thereto rotate about an (imaginary) axis 13 and between a bottom plate and top plate (not shown).

At both sides, the revolving door 10 serving as entrance and exit opening has a passage opening 15 leading to the interior or exterior, respectively.

In order to pass through the revolving door 10 the turning construction 11 has to rotate in, for example, the direction indicated by the arrow 14.

At the end 17 of the right-hand shell wall 16 of the revolving door 10 in the direction of rotation 14, there is an air-outflow unit 20. The air-outflow unit 20 blows radially into the section of the revolving door 10 in the direction indicated by arrow A. The air-outflow unit blows over the entire height between bottom plate and top plate. The air-outflow unit 20 is located at the inside of the building. Thus the section B of the revolving door 10 is in open communication with the atmosphere outside.

FIGS. 2 and 3 show a further exemplary embodiment of a revolving door 10 according to the invention. This one varies from the revolving door shown in FIG. 1 in that the turning construction 11 in this exemplary embodiment only has three door leaves 12. In addition, the direction of rotation of the turning construction 11 in the case shown in FIGS. 2 and 3 is contrary to that shown in FIG. 1. It will be obvious that this makes no difference to the invention.

At its rear side, the air-outflow unit 20 is provided with an inlet opening for in accordance with arrow 50 drawing in ambient air from the interior of the building. As explained earlier, this air is subsequently let into the section of the revolving door 10 in the direction of arrow A.

FIG. 4 shows a third exemplary embodiment of a revolving door according to the invention, which differs from the earlier examples in that it relates to a two-leaf revolving door.

In the case shown in FIG. 4, the direction of rotation 14 of the revolving door 10 is again the same as in the case shown in FIG. 1.

Although in each case of the exemplary embodiments only one air-outflow unit 20 is shown, it will be clear that the invention is not limited thereto, but that embodiments having an air-outflow unit at the inside and a similar air-outflow unit at the outside of the building, are equally well feasible. This may result in an even more effective separation between indoor climate and outdoor climate. Expediently, the air-outflow unit provided at the outside of the building also obtains the air to be drawn in from the interior of the building.

What is claimed is:

1. A revolving door for installation in a building comprising a cylindrical shell wall, within the shell wall door leaves rotating about a central shaft between a bottom plate and a top plate, and entrance and exit openings provided in the shell wall, at least one of which having an air-outflow unit disposed at a vertical edge of the shell wall, having an outlet slot for the generation of a vertically oriented air curtain disposed between the bottom plate and the top plate substantially filling the headroom of the door, wherein the outlet slot is directed substantially radially towards an interior of the revolving door, and wherein during use the door leaves provide an antidraught seal, with the air-outflow unit being placed inside the building.

2. A revolving door according to claim 1, wherein a second air-outflow unit is provided outside the building of which an outlet slot is directed substantially radially towards the interior of the revolving door.

3. A revolving door according to claim 1, wherein the air-outflow unit or air-outflow units have a suction opening for air that is in communication with an atmosphere inside the building.

* * * * *